United States Patent [19]

van Brussel et al.

[11] Patent Number: 4,735,159

[45] Date of Patent: Apr. 5, 1988

[54] EMBROIDERY MACHINE

[75] Inventors: Hendrik van Brussel, Kessel-Lo; Cornelius De Greef, Sint-Pieters-Leeuw; Johnny Hannon, Lembeek, all of Belgium

[73] Assignee: Titan-Baratto, Brussels, Belgium

[21] Appl. No.: 14,995

[22] Filed: Feb. 17, 1987

[51] Int. Cl.[4] ..... D05B 21/00; D05C 9/06

[52] U.S. Cl. ..... 112/121.12; 112/103

[58] Field of Search ..... 112/103, 102, 121.12, 112/121.14, 121.11, 266.1, 262.3, 78, 86, 98; 318/568; 364/470, 400

[56] References Cited

U.S. PATENT DOCUMENTS

| | | | |
|---|---|---|---|
| 3,750,186 | 7/1973 | Sakamoto | 112/102 X |
| 4,598,655 | 7/1986 | Takenoya | 112/103 |
| 4,622,907 | 11/1986 | Kimura | 112/103 X |

*Primary Examiner*—Peter Nerbun

*Attorney, Agent, or Firm*—Fishman & Dionne

[57] ABSTRACT

An embroidery machine is presented which automatically executes the embroidery designs stored on a storage medium by electronic and mechanical means; and which records the movements of an embroidery specialist, who executes as a model, the embroidery design to be produced automatically by the machine.

10 Claims, 3 Drawing Sheets

EMBROIDERY MACHINE

BACKGROUND OF THE INVENTION

This invention relates to an embroidery machine. More particularly, this invention relates to an embroidery machine which makes it possible to produce embroidery designs automatically on a suitable woven support.

It is well known that embroidery work is usually very intricate and has to be carried out by specialists. Consequently, attempts have been made to automate the embroidery work by adopting digitization techniques known in other fields of activity. However, the digitization of embroidered designs having highly diverse forms, with several thread colors and with variable thread concentrations, is very costly and requires the use of complicated equipment involving a high capital outlay. Moreover, if it is desired to be able to modify the castoff of the needle or needles, and the orientation of the thread in the embroidered design, automation by the technique described above becomes practically impossible with the technical means available at the present time.

The object of the present invention is to provide a new embroidery machine which makes it possible to produce embroidery designs automatically in accordance with a design stored in a memory, taking into account all of the parameters which apply when manual embroidery is carried out.

Another object of the present invention is to provide a very fast embroidery machine which makes it possible to execute, at a variable speed, the following relative needle/fabric movements: movements in the X and Y axes, angular rotation and needle cast-off.

Yet another object of the present invention is to provide an embroidery machine which automatically executes the embroidery designs stored on a storage medium by electronic and mechanical means; and which records the movements of an embroidery specialist who executes, as a model, the embroidery design to be produced automatically by the machine.

SUMMARY OF THE INVENTION

The present invention provides an automatic embroidery machine which uses the programming technique well known in the construction of robots operating by the "teach-by-example" method (recording during execution).

In accordance with the present invention, an embroidery machine of the type mentioned above, includes on its stand, at least one needle support associated with the drives for the vertical to-and-fro and cast-off movements, and a tension frame intended for the fabric to be embroidered and mounted so as to be rotatable about its central axis and displaceable in two perpendicular directions in the same plane at right angles to the central axis. The frame is equipped with means for reading the angular position, means for reading the positions in the X and Y directions, associated drives in the X and Y directions, and a rotary drive. The reading means is connected to an electronic processing unit which permits the storage of the information received during manual work; and which allows control of the above-mentioned drives in accordance with the stored information during automatic work.

In order to make it easier for the tension frame of the fabric to be embroidered to execute manual movements which are impeded by the friction of the drive mechanisms, the frame is mounted in a second frame via stress-sensitive probes which detect the forces exerted in the X and Y directions and which thus actuate the corresponding drives. This arrangement permits manual work which is assisted and which consequently becomes much easier. Advantageously, the various positions to be stored in the processing unit are read in the drives as a result of a special arrangement thereof which is known per se.

In accordance with a preferred embodiment of the present invention, the processing unit permits processing to be carried out in five axes, that is, in the X and Y directions, rotary movements, variable needle cast-off and the speed of the main drive motor for the movements of the needle head. Advantageously, the needle head has two or, preferably, three needles, thus making it possible to speed up both manual and automatic work.

The above-discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
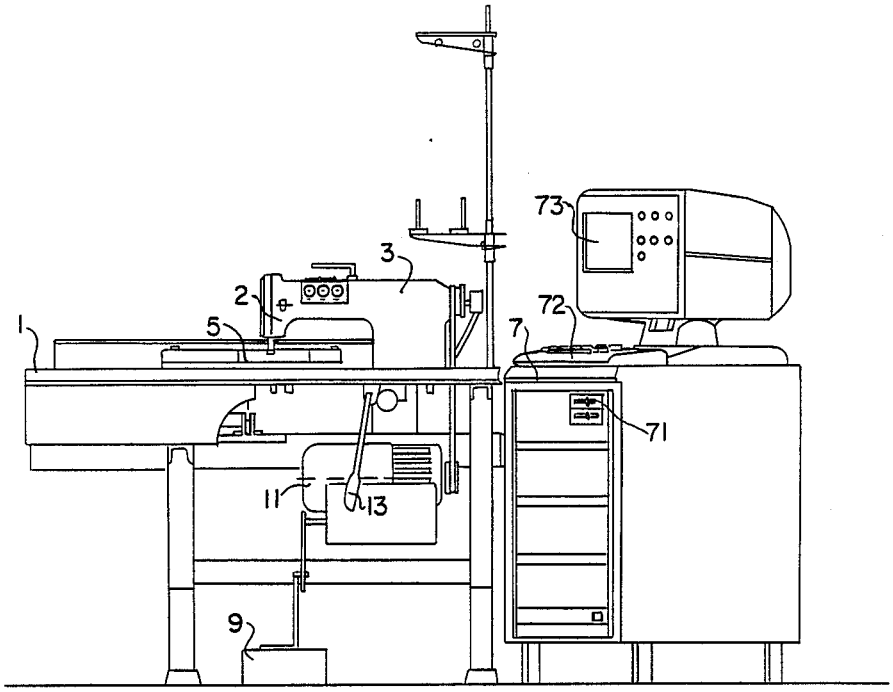
FIG. 1 is a front elevation view of the embroidery machine of the present invention.

With reference to FIG. 1, the embroidery machine of the present invention is comprised of a table 1 mounted on a table stand (known per se), a needle support 2 associated with drives 3 for the to-and-fro and cast-off movements of these needles, a movable tension frame 5 for the fabric to be embroidered, position reading means and drive means and an electronic processing unit 7.

The purpose of the embroidery machine in accordance with the present invention is to permit the recording of an embroidered design executed by a specialist, such that it can be repeated automatically as required. Furthermore, the manual movements of the fabric tension frame, which are impeded by mechanical friction, etc., are advantageously assisted in order to make the job easier for a specialized operator executing the embroidery design to be copied.

For this purpose (FIG. 2), the fabric tension frame 5 which is comprised of two rings 50 and 51, between which the fabric to be embroidered is stretched, is arranged in an annular frame 52 mounted so as to be rotatable about its central axis in movable frames 53 and 54 which are displaceable on table 1 in the X and Y directions. Mounted between the two frames 53 and 54 of movable frame 5 are stress-sensitive probes which, for example, take the form of annular elements 41 and 42 equipped with elements sensitive to the deformations of, for example, piezoelectric materials, or strain gages, and which make it possible to detect the operator's intention to shift the tension frame in a linear movement in the perpendicular X and Y directions. As a result, when the specialized operator exerts a force on fabric tension frame 5, the information detected is transmitted to the drive motors (not shown) of movable frame 53 and 54.

Figure 2:
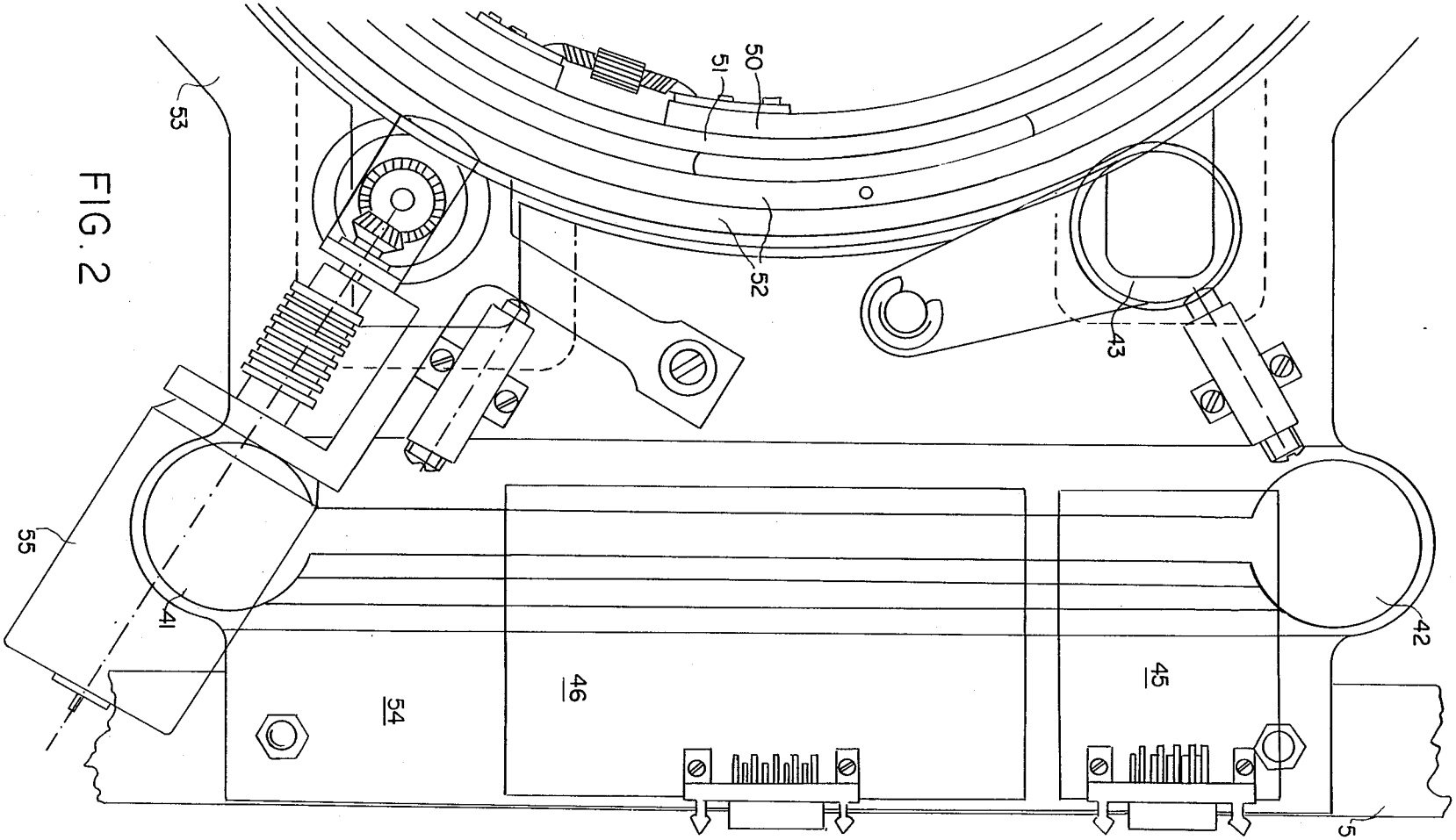
FIG. 2 is a partial plan view of the arrangement of the fabric tension frame of the present invention.

The rotary movements of the motors are transmitted to the annular frame 52 in a known way, for example, by means of non-slip rollers. Thus, the operator's movements are assisted and, because of the use of special motors (which are known), the various movements are also recorded and processed in processing unit 7 in order to be stored on, for example, a magnetic medium. FIG. 2 also shows the angular position reading device 43 (known per se) and electronic interface and preamplification circuits 45 and 46.

The other controls, such as the setting 9 of the speed of the main motor 11 driving the needles; and the setting 13 of the needle cast-off are similarly recorded in processing unit 7.

Processing unit 7 contains the electronic circuits necessary for regulating the drive motors, an information storage unit, such as, for example, a floppy-disk unit 71, and an operator communication unit, such as a keyboard 72 and a screen 73. Preferably, electronic processing unit 7 includes text processing functions which make it possible to compose, on the screen, fractions of an embroidered design which are executed by a specialized operator and recorded on floppy disks. It is thus possible to build up, on floppy disk, a "library" of embroidered designs which can be called up and composed so as to be executed automatically by the machine. The electronic processing unit 7 can also include functions which make it possible to modify the designs electronically, such as a modification of dimensions, deformation of the designs by the action of speed and other such variables.

Preferably, the rotational speed of main motor 11 is synchronized with the other movements. Also, the drive motors are regulated in accordance with the diagram shown in FIG. 3.

In a preferred embodiment of the present invention, the electronic processing unit 7 (FIG. 4) comprises two central or functional units, one unit being intended for receiving the information from the motors and for controlling the same, and the other unit intended for actual processing, such as storage, the text processing functions and the communication functions (for example by means of a keyboard and a screen). Preferably, the two functional units are controlled by a single microprocessor.

Figure 3:
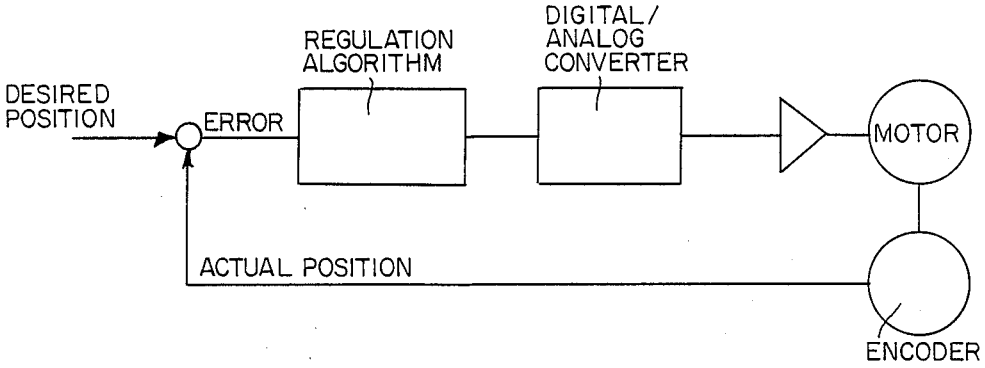
FIG. 3 is a schematic block diagram of the regulation loop of the drive motors used in the present invention.
Figure 4:
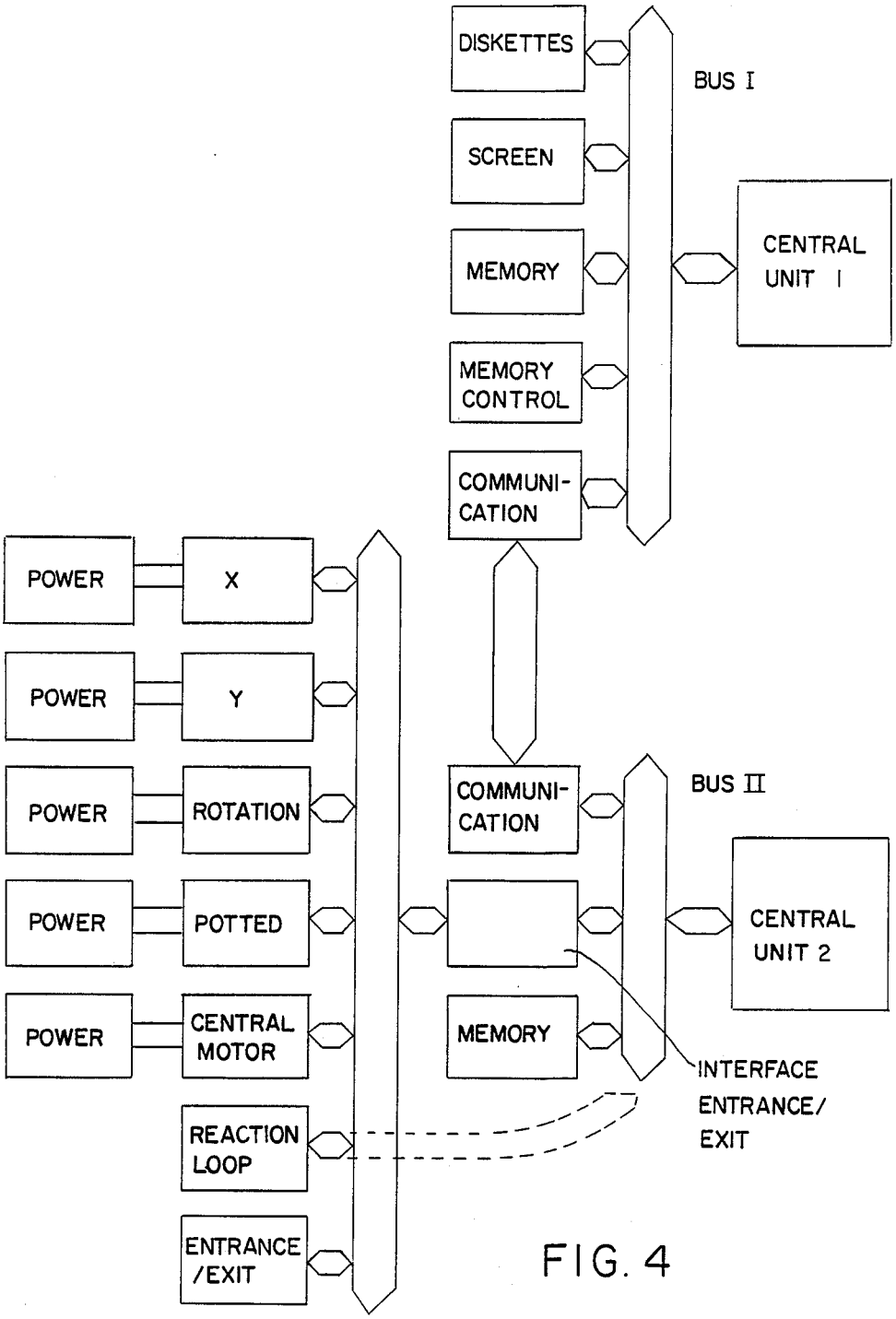
FIG. 4 is a schematic block diagram of the electronic control showing the various functions in the processing unit of the present invention.

It will be appreciated that FIGS. 3 and 4 will be easily understood by a person of ordinary skill in the art; and that electronic processing unit 7 as described in FIG. 4 and the regulation of the drive motors as described in FIG. 3 could be made and used by said person of ordinary skill in the art from a review of the foregoing specification and drawings.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An automatic embroidery machine comprising:

a stand, at least one needle head with at least one needle on said stand, said needle head being associated with drive means for vertical to-and-fro movements and for cast-off movements;

tension frame means for holding the fabric to be embroidered, said frame means mounted on said stand and adapted to be rotatable about its central axis and displaceable in two perpendicular directions in a single plane at right angles to the central axis, said frame means including;

means for reading the angular position of the frame;

means for reading the positions of the frame in the x and Y directions;

drive means in the X and Y directions;

rotary drive means;

said reading means being connected to an electronic processing unit whereby information received during manual work is stored and whereby said drive means are controlled in accordance with the stored information during automatic work; and stress-sensitive probes which detect the forces exerted by an operator on said frame means and which, via said electronic processing unit, transmit the stored information to said drive means thereby driving the movements of said frame means.

2. The machine as claimed in claim 1 wherein:

said means for reading the positions in the X and Y directions are incorporated in said drive means.

3. The machine as claimed in claim 1 wherein:

said stress-sensitive probes comprise elements equipped with strain gages.

4. The machine as claimed in claim 1 wherein said fabric tension frame means comprises:

two rings between which the fabric to be embroidered is stretched; and said two rings being arranged in an outer ring which is mounted so as to be rotatable about its central axis in inner and outer movable frame means which are displaceable in the X and Y directions, said probes being mounted between said inner movable frame means and said outer movable frame means.

5. The machine as claimed in claim 1 wherein:

said electronic processing unit processes data in five axes defining movements in the X and Y directions, rotary movements, variable needle cast-off and the speed of the main drive motor for the needle head.

6. The embroidery machine as claimed in claim 1 wherein:

the manual steps are recorded on a magnetic medium in said electronic processing unit.

7. The embroidery machine as claimed in claim 1 wherein: said electronic processing unit includes "text processing" and "communication processing" functions.

8. The embroidery machine as claimed in claim 1 wherein:

said electronic processing unit includes a keyboard and a screen.

9. The embroidery machine as claimed in claim 8 wherein:

said electronic processing unit comprises two functional units, one of said units being intended for receiving information from said drive means and for controlling said drive means and the other of said units being intended for actual processing, the text processing functions and the communication functions.

10. The embroidery machine as claimed in claim 9 including:

a single microprocessor for controlling said two functional units.

* * * * *